US011835324B2

(12) United States Patent
Hawkins et al.

(10) Patent No.: US 11,835,324 B2
(45) Date of Patent: Dec. 5, 2023

(54) TRACKING DEVICE, SYSTEM, AND METHOD FOR USE WITH AN ARROW

(71) Applicants: Daniel R Hawkins, Sullivan, MO (US); Dale R Jones, Steelville, MO (US)

(72) Inventors: Daniel R Hawkins, Sullivan, MO (US); Dale R Jones, Steelville, MO (US)

( * ) Notice: Subject to any disclaimer, the term of this patent is extended or adjusted under 35 U.S.C. 154(b) by 0 days.

(21) Appl. No.: 17/823,287

(22) Filed: Aug. 30, 2022

(65) Prior Publication Data

US 2023/0119245 A1 Apr. 20, 2023

Related U.S. Application Data

(63) Continuation of application No. 17/304,597, filed on Jun. 23, 2021, now Pat. No. 11,428,518.

(60) Provisional application No. 63/046,914, filed on Jul. 1, 2020.

(51) Int. Cl.
*F42B 12/38* (2006.01)

(52) U.S. Cl.
CPC ..... *F42B 12/385* (2013.01)

(58) Field of Classification Search
CPC ..... F42B 6/04; F42B 12/385; F42B 12/365
USPC ..... 473/570, 578
See application file for complete search history.

(56) References Cited

U.S. PATENT DOCUMENTS 4,704,612 A * 11/1987 Boy ..... G01S 1/68 473/578
4,885,800 A * 12/1989 Ragle ..... F42B 12/385 473/578
4,940,245 A * 7/1990 Bittle, Jr. ..... A01M 31/00 473/578
4,976,442 A * 12/1990 Treadway ..... F42B 12/385 473/578
5,157,405 A * 10/1992 Wycoff ..... F42B 12/385 473/578
5,188,373 A * 2/1993 Ferguson ..... F42B 12/385 473/578
6,764,420 B2 * 7/2004 Cyr ..... F42B 6/06 473/578
7,300,367 B1 * 11/2007 Andol ..... F42B 6/04 473/578
7,331,887 B1 * 2/2008 Dunn ..... F42B 12/385 473/578
7,632,199 B2 * 12/2009 Kikos ..... F42B 12/385 473/578
8,192,309 B1 * 6/2012 Roberts ..... F42B 12/385 473/578
8,216,097 B2 * 7/2012 Nick ..... F42B 12/385 473/578

(Continued)

*Primary Examiner* — Alexander R Niconovich
(74) *Attorney, Agent, or Firm* — McAughan Deaver PLLC

(57) ABSTRACT

A tracking system for use with an arrow including a base unit defining an open central section; a holding magnet positioned within the open central section; and a sending unit that includes an electronic circuit; a main body section affixed to an electronic circuit; projections extending from the main body section into the open central section and at least partially surrounding the holding magnet; and a projection extending from the main body section and ending in a point; where the electronic circuit includes a battery and is constructed to emit a tracking signal when activated and the electronic circuit includes a magnet switch element such that the electronic circuit is maintained in a deactivated state as a result of the magnetic field established by the holding magnet.

20 Claims, 7 Drawing Sheets

(56) References Cited

U.S. PATENT DOCUMENTS

| | | | | |
|---|---|---|---|---|
| 8,221,273 | B2 * | 7/2012 | Donahoe | A63B 69/00 473/578 |
| 8,393,982 | B2 * | 3/2013 | Ferguson | F41B 5/1438 473/578 |
| 8,425,354 | B2 * | 4/2013 | Ferguson | F42B 12/385 473/578 |
| 8,795,109 | B2 * | 8/2014 | Roman | F42B 12/38 473/578 |
| 8,974,326 | B2 | 3/2015 | Ferguson | |
| 9,062,947 | B1 * | 6/2015 | Patel | F42B 6/04 |
| 9,075,124 | B2 * | 7/2015 | Zusman | G01S 3/40 |
| 9,307,300 | B2 * | 4/2016 | DiSanto | F42B 6/02 |
| 9,316,469 | B2 * | 4/2016 | Parker | F42B 12/382 |
| 9,964,384 | B2 * | 5/2018 | Parker | F42B 12/365 |
| 10,401,136 | B1 * | 9/2019 | VanTassell | G01S 19/35 |
| 10,495,428 | B1 * | 12/2019 | Patel | F42B 12/382 |
| 10,563,965 | B1 * | 2/2020 | Soin | G01S 19/19 |
| 10,760,883 | B2 * | 9/2020 | Vaquer Tarrago | F42B 15/08 |
| 10,871,357 | B2 * | 12/2020 | Ferguson | G01S 19/13 |
| 11,047,658 | B2 * | 6/2021 | Ferguson | F42B 12/40 |
| 11,428,518 | B2 * | 8/2022 | Hawkins | F42B 12/385 |
| 11,549,792 | B2 * | 1/2023 | Hogan | H04W 4/029 |
| 11,686,563 | B2 * | 6/2023 | Ferguson | G01S 19/19 473/570 |
| 2007/0142137 | A1 * | 6/2007 | Davenhaver | F42B 12/385 473/578 |
| 2012/0172158 | A1 * | 7/2012 | Kirsch | F42B 12/385 473/578 |
| 2016/0146584 | A1 * | 5/2016 | Shepherd | G01S 19/51 340/539.32 |
| 2018/0142996 | A1 * | 5/2018 | Wetzler | F42B 12/385 |

* cited by examiner

TRACKING DEVICE, SYSTEM, AND METHOD FOR USE WITH AN ARROW

CROSS REFERENCE TO RELATED APPLICATIONS

This application claims priority to U.S. Provisional Application No. 63/046,914 entitled "Tracking Device, System and Method For Use With an Arrow," which was filed on Jul. 1, 2021, which is hereby incorporated by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to devices, apparatus, systems, and methods for tracking a target hit by an arrow, such as a killed or wounded game animal.

Description of the Related Art

When hunting with a bow and arrow, it is desirable to be able to efficiently track any target struck by the arrow. Often such targets do not fall immediately when hit and, instead, wander far from the location where they were initially hit.

In an effort to permit efficient tracking of hit, moving targets, a variety of different electronic tracking systems have been developed.

For example, U.S. Pat. No. 4,976,442, entitled "Arrow With Removable Transmitter and Method of Use," discloses an arrow having a removable, battery-operated transmitter with an antenna, that is adapted to fit in a notch or slot provided in the arrow shaft, where the transmitter is provided with a curved hook that terminates in a sharp hook tip having a barb. The hook tip and barb are designed to project through the slot or notch in the arrow shaft and engage and remain in the hide, hone or tissue of a deer or other game animal when the arrow strikes the animal, wherein the force of the strike is intended to cause the transmitter to exit the notch in the arrow shaft and remain in the animal, regardless of the arrow location. The transmitter is designed to remain in the animal and emit a radio signal capable of being received by a portable radio receiver to track the game animal if a clean kill is not made. Alternatively, if the arrow misses the intended target, the radio signal is intended to permit location of the arrow. The specific arrangement of the barbed hook and transmitter in this design is believed potentially interfere with the manner in which the arrowhead on the arrow penetrates any hit game animal, potentially reducing the potential lethality of a shot.

As another example, U.S. Pat. No. 9,316,469, entitled "Electronic Tracking System" discloses electronic tracking system for obtaining geographic or other information about a targeted object from deployed ordnance. The systems disclosed in such patent are, in many instances, very complicated and potentially involve the use of overhead drones and satellites for tracing purposes.

The use of the systems as described above pose several challenges that may be overcome through the exemplary embodiments described in this disclosure.

BRIEF SUMMARY OF THE DISCLOSURE

A brief non-limiting summary of one of the many possible embodiments of the present disclosure is:

A tracking system for use with an arrow including a base unit defining an open central section; a holding magnet positioned within the open central section; and a sending unit that includes an electronic circuit; a main body section affixed to an electronic circuit; projections extending from the main body section into the open central section and at least partially surrounding the holding magnet; and a projection extending from the main body section and ending in a point; where the electronic circuit includes a battery and is constructed to emit a tracking signal when activated and the electronic circuit includes a magnet switch element such that the electronic circuit is maintained in a deactivated state as a result of the magnetic field established by the holding magnet.

Other potential aspects, variants and examples of the disclosed technology will be apparent from a review of the disclosure contained herein.

None of these brief summaries of the inventions is intended to limit or otherwise affect the scope of the appended claims, and nothing stated in this Brief Summary of the Disclosure is intended as a definition of a claim term or phrase or as a disavowal or disclaimer of claim scope.

DESCRIPTION OF THE VIEWS OF THE DRAWINGS

The following figures form part of the present specification and are included to demonstrate further certain aspects of the present invention. The invention may be better understood by reference to one or more of these figures in combination with the detailed description of specific embodiments presented herein.

Figure 1:
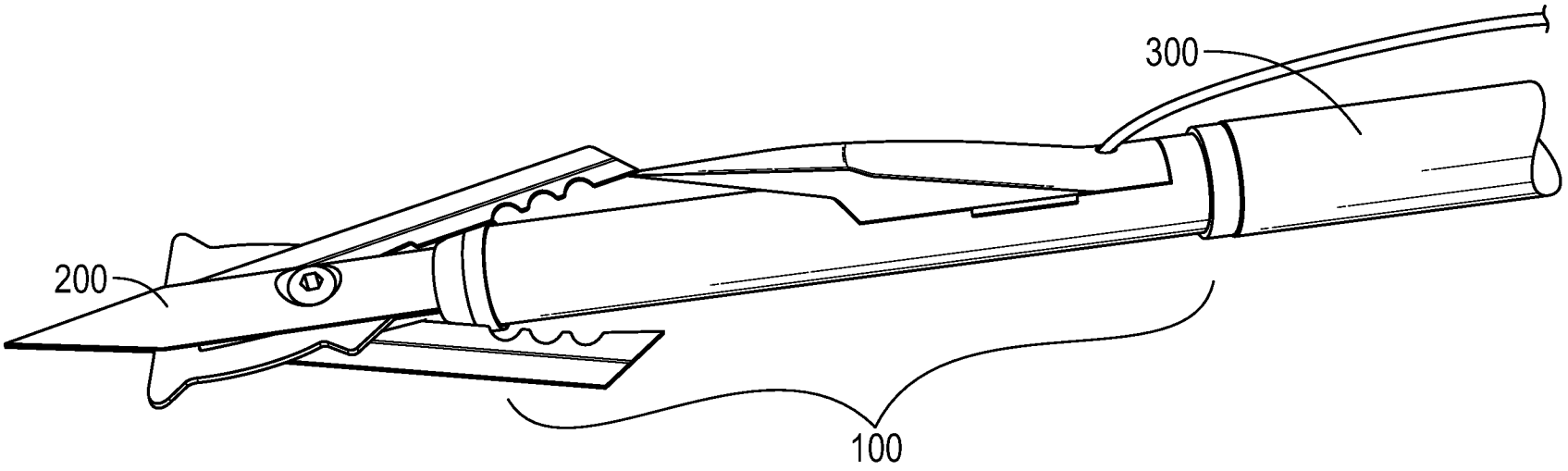
FIG. 1 illustrates an improved Tracking System 100 that, in the illustrated example, is attached at one end to an arrow broadhead 200 and, on another end, to an arrow shaft 300.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

FIG. 1 illustrates an improved Tracking System 100 that, in the illustrated example, is attached at one end to an arrow broadhead 200 and, on another end, to an arrow shaft 300. The particular broadhead 200 is exemplary only and any suitable arrow tip may be used without departing from the teachings of this disclosure. Likewise, the arrow shaft 300 illustrated in FIG. 1 is exemplary and any suitable shaft may be used. The shaft 300 of FIG. 1 may include fletching (not illustrated) to guide the arrow in flight and a nock (also not illustrated) for positioning the arrow relative to a bowstring.

In the illustrated example, the Tracking System 100, includes only three main components (discussed in more detail below), namely: a Base Unit, Holding Magnet, and a Sending Unit.

In the illustrated example of FIG. 1, the Tracking System 100 is illustrated as a system separate from the broadhead 200 and the arrow shaft 300. Alternate embodiments of the system disclosed in FIG. 1 (and all other systems disclosed herein) are envisioned wherein the Tracking System 100 is formed integrally with an arrow tip (such as a broadhead), an arrow shaft, or both an arrow tip and an arrow shaft.

Figure 2:
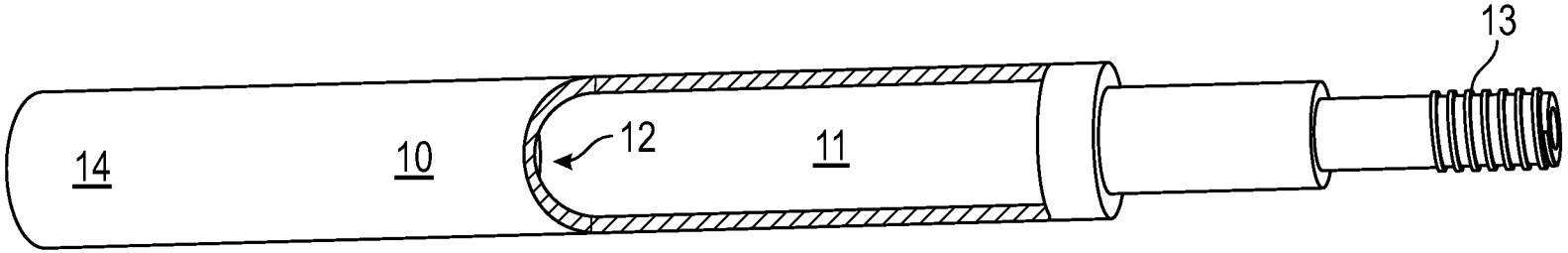
FIG. 2 illustrates an exemplary Base Unit 10.

FIG. 2 illustrates an exemplary Base Unit 10. In the example of FIG. 2, the Base Unit 10 is a generally tubular structure having a main central section 11 that defines a partially open tube of a first general diameter and a closed tubular section 12. In the example of FIG. 2, the inner diameter of the closed tubular section 12 is less than that of the main central section 11, although that relationship need not always exist. One the ends of the Base Unit 10 is located opposite the closed tubular section 12. The Base Unit 10 defines a first section that is generally cylindrical in outer appearance and that defines a projection 13 adapted for attachment to an arrow shaft. In the example of FIG. 1, the projection 13 defines male threads that can be coupled to a female threaded opening in an arrow shaft in a generally conventional manner. On the end of the Base Unit 10 closest to the closed tubular section 12, the Base Unit 10 defines a second section 14, generally cylindrical in appearance, that is adapted for attachment to an arrow tip, such as a broadhead. In the example of FIG. 1, the second section 14 defines a female receptacle including inner threads suitable for coupling to a male threaded member extending from an arrow tip.

The Base Unit 10 may be formed, cast, or molded from any suitable material and, in one exemplary embodiment, is formed from a non-magnetic material. The material used to form the Base Unit 10 should be sufficiently rigid to act as an extension of the arrow shaft 300, but—in general—should have a weight below that which could substantially affect the trajectory of an arrow tip/shaft combination not including the Base Unit 10. In one preferred embodiment, the Base Unit 10 is below 60 grains, and in a still further embodiment is within 5 grains (plus or minus) of 50 grains. The material used to form Base Unit 10 may be aluminum, carbon fiber, high-strength plastic, titanium, ceramic, or any other suitable high-strength, light weight material.

Figure 3:
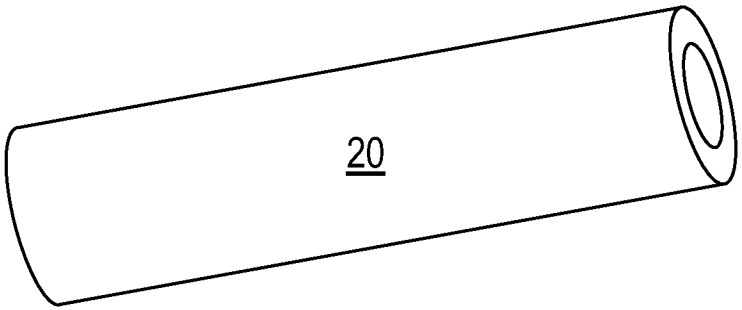
FIG. 3 illustrates an exemplary Holding Magnet 20.

FIG. 3 illustrates an exemplary Holding Magnet 20. In the illustrated example the Holding Magnet 20 takes the form of a rod-like structure, having a generally circular outer diameter that is relatively constant along the length of the rod. It will be appreciated, however, that the Holding Magnet 20 may be formed in other shapes and that other outer diameters (e.g., square, triangular, hexagonal, etc.) may be employed without departing from the teachings of the present disclosure.

In general, the diameter of the Holding Magnet 20 is such that it can be placed within the opening of the main central section 11 of the Base Unit 10 and positioned, at least partially, within the closed tubular section 12 of the Base Unit 10. In one embodiment, the longitudinal length of the Holding Magnet 20 is such that it can be fitted completely within the closed section 12 of the Base Unit 10, with no portion of the Holding Magnet 20 extending into the open main central section 11 of Base Unit 10. In other embodiments, the longitudinal length of the Holding Magnet 20 is such that at least a portion of it will always extend into the open section of the main central section 11 of the Base Unit 10.

To maintain the overall weight of the Tracking System 100 within desired limits, the overall weight of the Holding Magnet 20 should, in one preferred embodiment, be maintained to be on the order of 10 grains and, in one example, within 2 grains (plus or minus) of 10 grains.

Figure 4A:
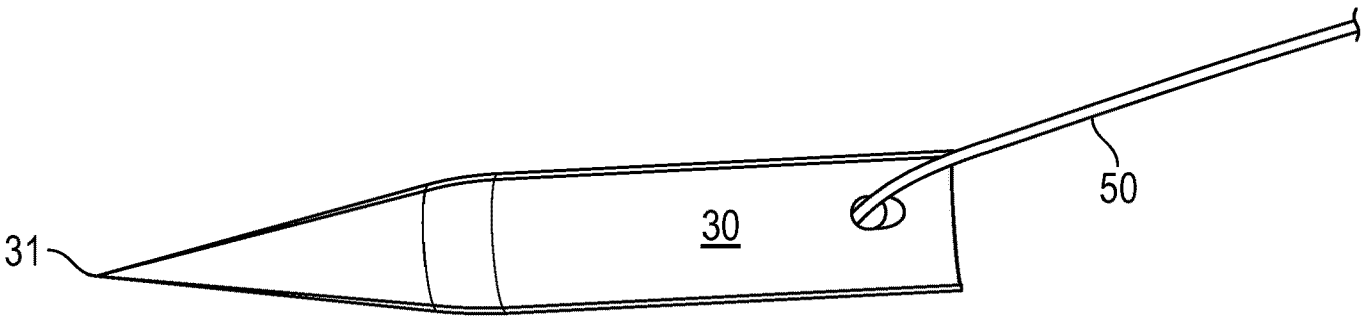
FIGS. 4A and 4B generally illustrate an example embodiment of a Sending Unit 30.
Figure 4B:
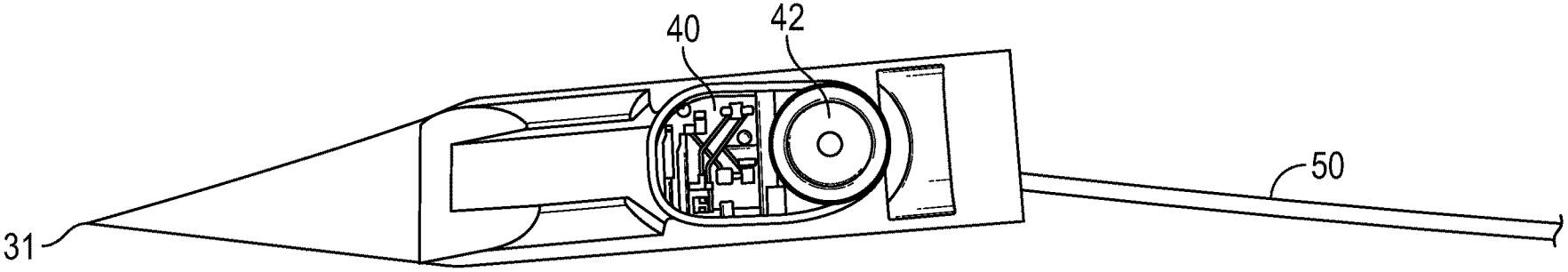

FIGS. 4A and 4B generally illustrate an exemplary embodiment of a Sending Unit 30. In the illustrated example, the Sending Unit 30 defines a main body that defines, on one end, a projection 31 that tapers to a fine point. On the end opposite the pointed section, the main body defines an opening through which an externally extending antenna element 50 (discussed in more detail below) may pass.

A top view of the exemplary Sending Unit 30 is depicted in FIG. 4A. A bottom view of the exemplary Sending Unit 30 is depicted in FIG. 4B.

As illustrated in FIG. 4B a Transmitter Assembly 40 is positioned inside a suitable space within the main body of the Sending Unit 30. In the illustrated example the Transmitter Assembly 40 includes an electronic circuit arrangement that, when activated, emits a signal that may be detected and, therefore, used to track the location of the Transmitter Assembly 40. In some preferred embodiments, the Transmitter Assembly 40 may be encapsulated in an epoxy, resin, or other suitable material to protect it from the environment and from fluids (rain, blood, etc.) that it may come in contact with. The Transmitter Assembly 40 may be affixed to the main body of the Sending Unit 30 via epoxy, gluing, a physical connection, or any other arrangement that fixedly or removably attaches the Transmitter Assembly 40 to the main body.

In the example of FIG. 4B, the Transmitter Assembly 40 includes a small battery 42, illustrated in the figure as a circular disk. The small battery should be of sufficient power that it can power the Transmitter Assembly 40, when the Transmitter Assembly 40 is activated. As illustrated in FIGS. 4A and 4B, an externally extending antenna element 50 extends from the Transmitter Assembly 40 and through an opening in the sending unit. The antenna element 50 is used to transmit the tracking signal emitted by the Transmitter Assembly 40 when it is activated. It should be appreciated that certain embodiments of the Transmitter Assembly 40 may be able to adequately broadcast a tracking signal without an externally extending antenna, such that the passage of an antenna element through the body of the Sending Unit 30 would be unnecessary. For example, embodiments are envisioned wherein an antenna is provided that does not extend through the body of the Sending Unit. In other words, applicants envision embodiments where an antenna is formed integrally within or as part of the body of the Sending Unit 30.

In certain exemplary embodiments, primarily to preserve battery life, the circuitry within the Tracking Assembly 40 may include a magnetic switch that will activate the electronic circuit whenever the circuit is not in the presence of a sufficiently strong magnetic field and will maintain the electronic circuit in a non-activated state whenever it is in the presence of a sufficiently strong magnetic field. Such a circuit may be used, in combination with Holding Magnet 20, and the Base Unit 10, to form a long-life tracking system that can optimize battery usage. Aspects of such a system are disclosed in FIGS. 5A and 5B.

Figure 5A:
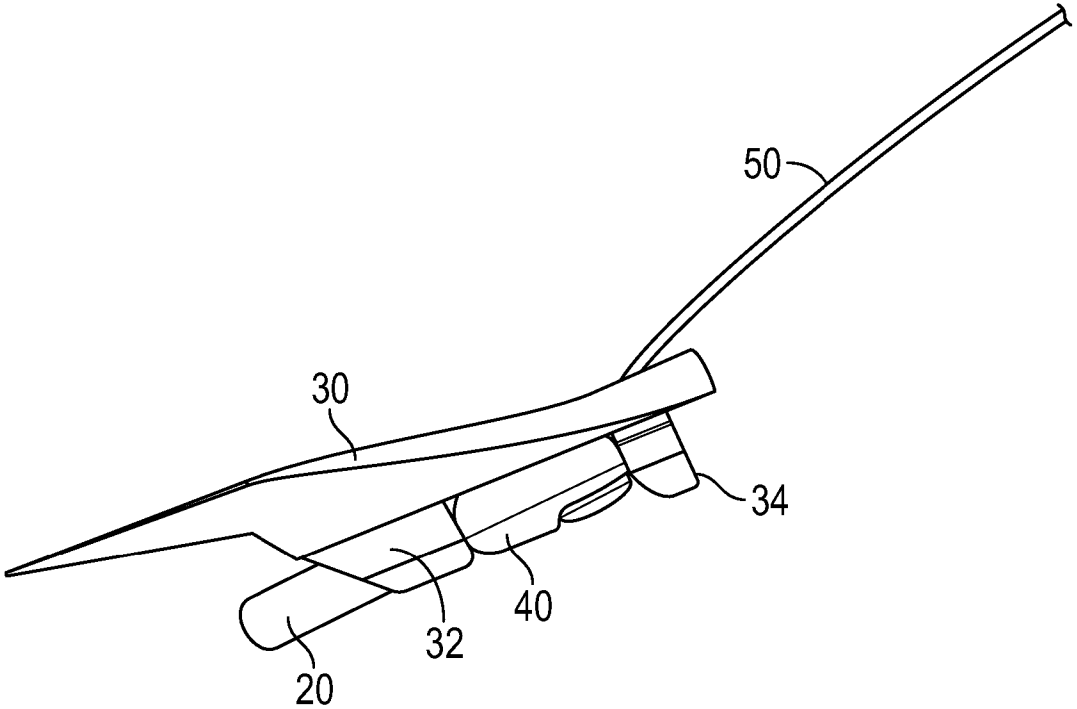
FIGS. 5A and 5B generally illustrate aspects of an exemplary Tracking Assembly that includes a magnetic switch that will activate an electronic circuit within the assembly whenever the circuit is not in the presence of a sufficiently strong magnetic field and will maintain the electronic circuit in a non-activated state whenever it is in the presence of a sufficiently strong magnetic field.

FIG. 5A illustrates a side view of a combination of an exemplary Sending Unit 30 and a Holding Magnet 20. As illustrated in the figure, the illustrated Sending Unit 30 includes downward projections 32, 34 that define an open space into which the Holding Magnet 20 may be removably received. When positioned within the space, the Holding Magnet 20 is sufficiently close to the electronic circuit within the Transmitter Assembly 40 to render the circuitry non-active. In this state, little or no battery current is drawn and the charge available from the battery is generally maintained. In one embodiment, the downward projections 32, 34 only loosely position the Holding Magnet 20 relative to the Sending Unit 30 and it is the magnetic attraction between the holding magnet and the battery within the Transmitter Assembly 40 that maintains the Holding Magnet 20 in a relatively fixed location relative to the Transmitter Assembly. In some of many other embodiments, the downward projections 32, 34 abut the Holding Magnet 20 in such a manner as to hold the Holding Magnet 20 in a relatively fixed position relative to the Sending Unit 30 through a snap-fit-type connection.

Figure 5B:
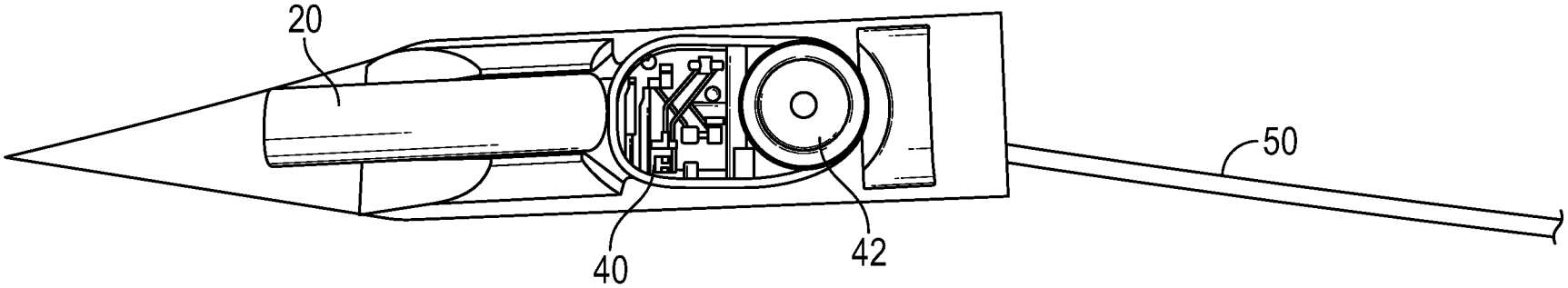

FIG. 5B illustrates a bottom view of the combination depicted in FIG. 5B. As illustrated in the figure, the downward projections extending from the main body of the Sending Unit 30 partially wrap around the bottom of the Holding Magnet 20 to generally align the longitudinal axis of the Holding Magnet 20 with the Transmitter Assembly 40. This helps to ensure that, in the exemplary disclosed arrangement, the magnetic field will maintain the electronic circuitry within the Transmitter Assembly 42 in a non-activated state.

Figure 6A:
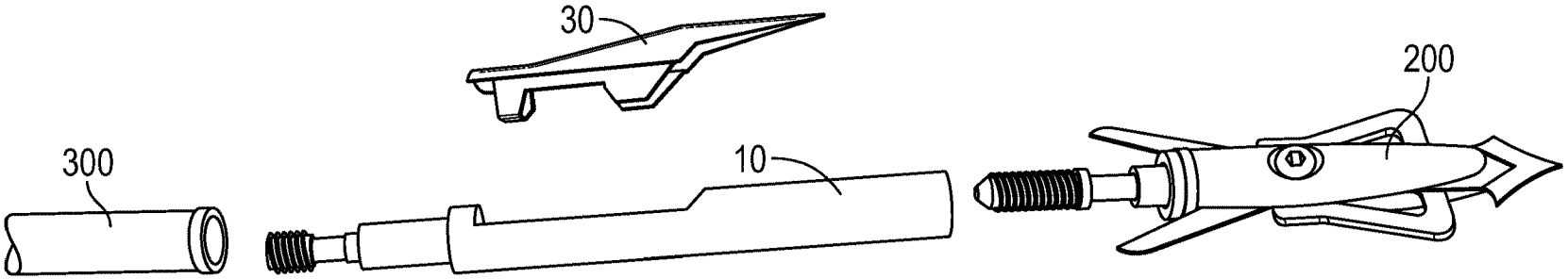
FIGS. 6A, 6B and 6C illustrate additional details of the exemplary Sending Unit 30 of FIGS. 5A and 5B.
Figure 6B:
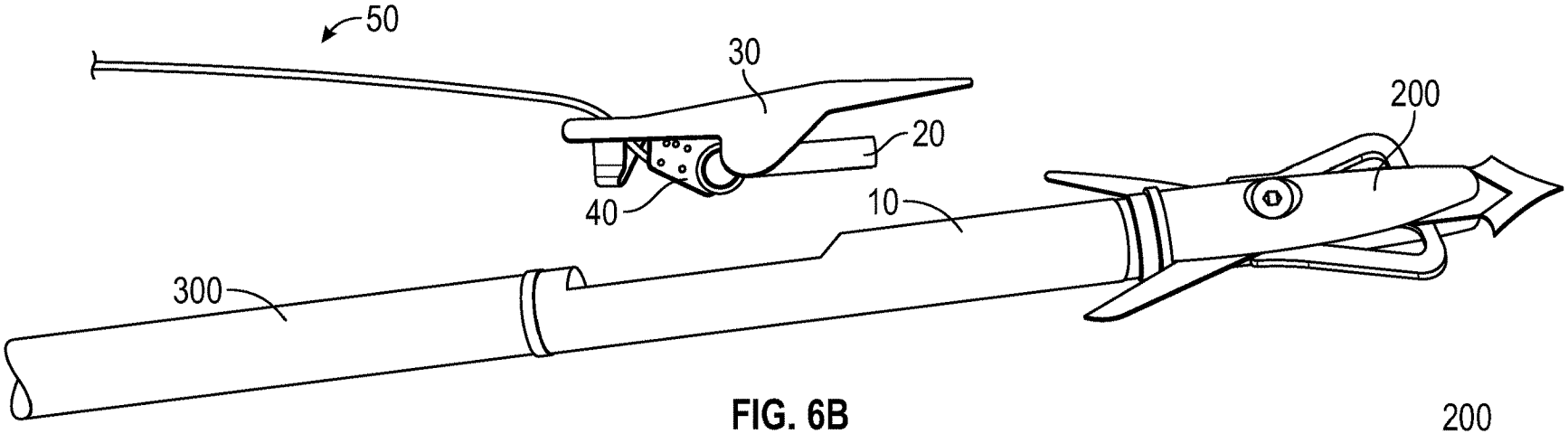
Figure 6C:
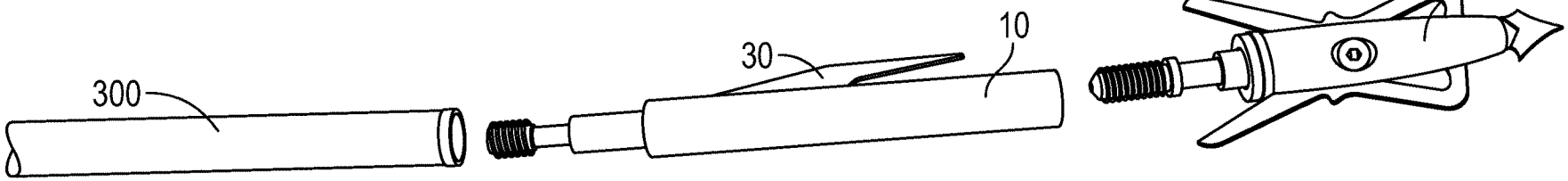

Additional details of the exemplary Sending Unit 30 of FIGS. 5A and 5B are depicted in FIGS. 6A, 6B and 6C. In particular, FIG. 6A—which depicts the Sending Unit 30 without the Transmitter Assembly 40—provides a side view of the downward projections discussed above. FIG. 6B provides additional details concerning the layout of the Transmitter Assembly 40. Of note, the Transmitter Assembly 40 is depicted in FIG. 6B in a side orientation and not as it would be oriented when fixed within the main body of the Sending Unit 30.

FIG. 6C illustrates the Tracking System 100 as full assembled, with the Holding Magnet 20 positioned within the Base Unit 10 and the Sending Unit 30 positioned such that its main body (and the Transmitter Assembly 42) is located within the open main section 11 of the Base Unit 10. As illustrated in FIG. 6C, when assembled as depicted, the pointed end of the Sending Unit 30 projects towards the tip of the arrow and some offset may exist between the pointed tip of the Sending Unit 30 and the Base Unit 10.

The Sending Unit 30 may be made of any suitable material, including any of the materials discussed above with respect to the Base Unit 10.

To maintain the overall weight of the Tracking System 100, the overall weight of the Sending Unit should be maintained to be on the order of 30 grains and, in certain preferred embodiments, within 5 grains (plus or minus) of 30 grains.

Ideally the total weight of the complete Tracking System 100 (including Base Unit, Holding Magnet, and Sending Unit) will be under 100 grains and preferably approximately 90 grains.

Figure 7A:
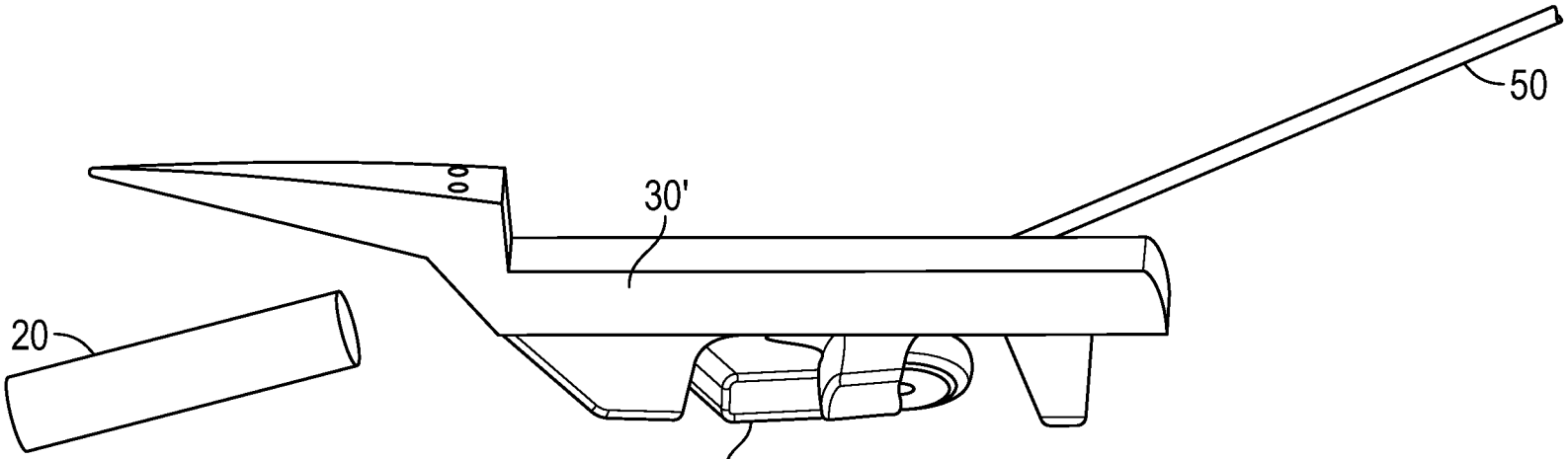
FIGS. 7A and 7B illustrate an alternate design for a Sending Unit.
Figure 7B:
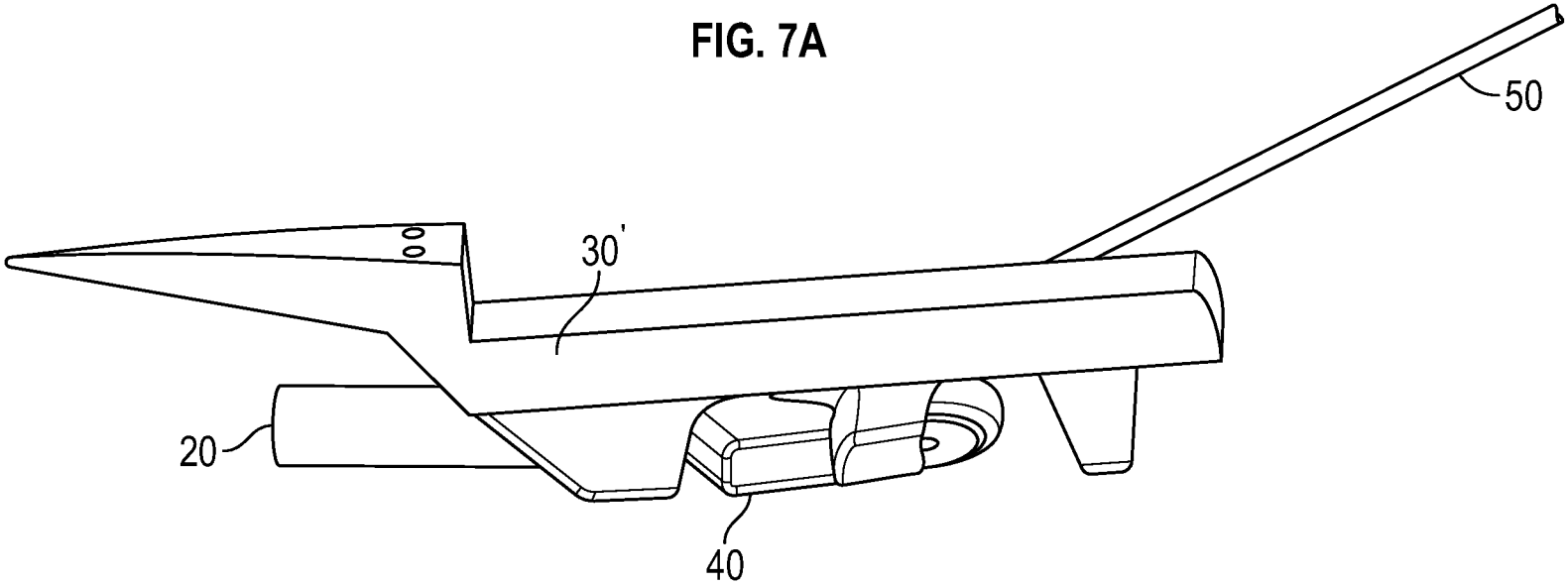

It should be appreciated that the specific shape of the Sending Unit 30 described above is exemplary only and that Sending Units of different shapes and appearance may be used without departing from the teachings of this disclosure. FIGS. 7A and 7B illustrate one such alternate design wherein a Sending Unit 30' is disclosed.

In use, an assembled Tracking System 100 may be positioned between the shaft 300 and tip 200 of an arrow assembly. When the arrow is shot and hits a target, such as legal game animal, the projecting tip of the Sending Unit 30 will embed itself into the skin, flesh or other portion of the game animal and cause the Sending Unit 20 to pull away from the Holding Magnet 20. This pulling away may be accomplished in many of several ways known to those ordinarily skilled in the art. In accordance with one embodiment, the impact of the arrow on the target combined with the forward movement of the Holding Magnet 20 may cause the Holding Magnet 20 to move into the interior cavity of the Base Unit 10, thus separating the Holding Magnet 20 from the Sending Unit 30. This movement will reduce or eliminate the magnet coupling between the Sending Unit 30 and the Holding Magnet 20, thus releasing the Sending Unit 30 and allowing it to pull away. In an alternative embodiment, the embedding of the tip of the Sending Unit 30 in the target, combined with the forward movement of the arrow, may cause the Sending Unit 30 to become disengaged from the Holding Magnet 20 and the Base Unit. In a still further exemplary embodiment, a combination of movements of the Holding Magnet 20 resulting from the arrow hitting the target, and the Sending Unit 30 partially entering the target may cause the Sending Unit 30 break away.

Figure 9:
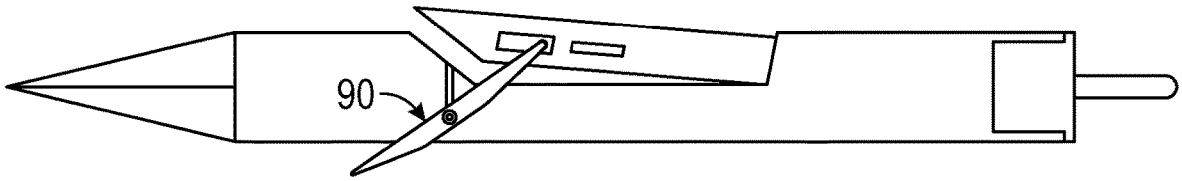
FIG. 9 illustrates an alternate embodiment of the disclosed system in which a lever assembly may be used to effectively push the Sending Unit out of the Base Unit.

Other methods for causing or permitting the Sending Unit 30 to disengage from the Base Unit 30 may be envisioned by those in possession of this disclosure. For example, as reflected in FIG. 9, a lever assembly 90 may be used to effectively push the Sending Unit 30 out of the Base Unit 10. In this exemplary embodiment, a lever 90 may be provided that extends from a portion of the Base Unit 30 opposite the central opening. When the arrow hits the target, the lever will be moved, causing to effectively pry the Sending Unit 30 out of the Base Unit 10.

The described approaches for disengaging the Sending Unit 30 from the Base Unit 10 upon the arrow hitting a target are believed to allow the arrow (and specifically the broad tip) to continue through the target essentially uninterrupted. As such, a well-placed shot intended to produce a quick kill of a game animal will continue along its original path, such that the desired path of the arrow through the target may be obtained and the user of the Tracking System need not adjust their aim or shooting style to accommodate the tracking system.

As the Sending Unit 30 pulls away from the Base Unit 1, the Base Unit 10 may remain in a fixed position relative to the shaft 300 and tip 200 and continue moving through the target. Because the Sending Unit 30 is held within the Base Unit 10 primarily by the magnetic force of Holding Magnet 20, the Sending Unit 30 will begin to separate from the Base Unit 10, without inducing any forces that may substantially affect the trajectory of the arrow into (and potentially completely through) the target. As the Sending Unit 30 separates from the Base Unit 10, a point will be reached where the magnetic field adjacent the Tracking Assembly 40 in the Sending Unit 30 is sufficiently weakened to the extent that the electronic circuit within the Tracking Assembly 40 becomes active and the tracking assembly will begin to emit a tracking signal that may be detected by a suitable tracking device.

In one of many exemplary embodiments, as the Sending Unit 30 separates from the Base Unit 10, the Holding Magnet 20 will be pulled by magnetic force into the closed tubular section 12 of the Base Unit 10. This may occur as a result of the magnetic attraction between the Holding Magnet 10 and the material forming part of the broadhead/arrow tip 200.

Figure 8:
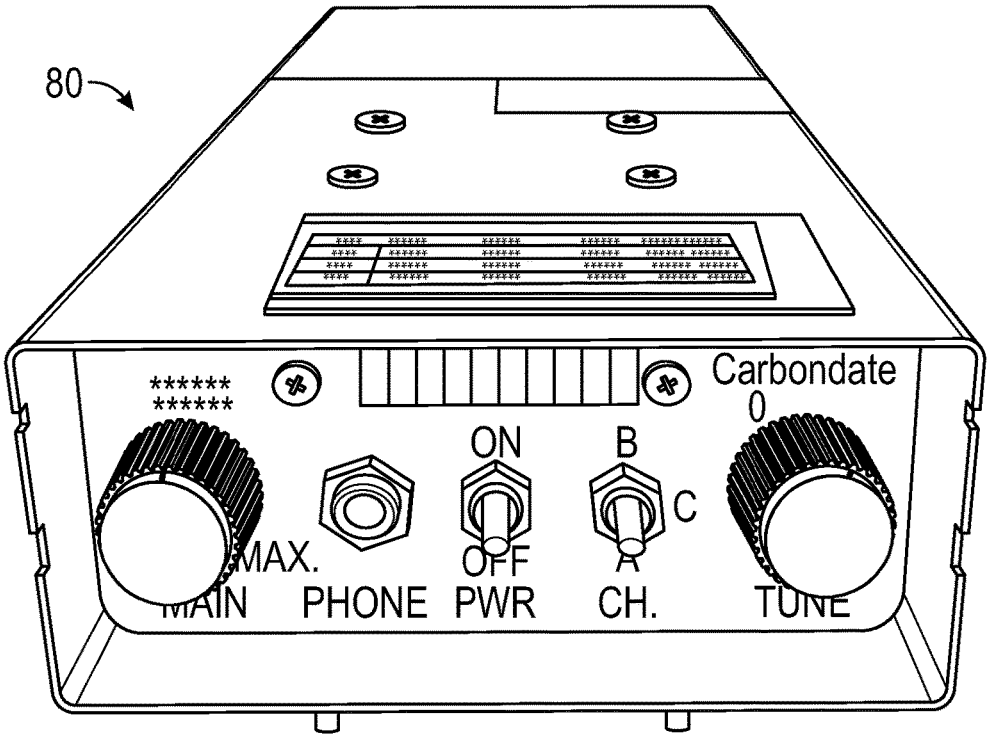
FIG. 8 illustrates an existing tracking device that may be used to detect the emitting tracking signal and guide the user of the system to a Sending Unit and, ideally, to a target in which the Sending Unit is embedded or to which the Sending Unit is affixed.

FIG. 8 illustrates an exemplary tracking device 80 that may be used to detect the emitting tracking signal and guide the user of the system to the Sending Unit 30 and, ideally, to the target in which the Sending Unit 30 is embedded or to which the Sending Unit 30 is affixed. In one exemplary embodiment the tracking device may emit an audible signal (such as a beeping pattern) that becomes louder when the tracking device is pointed in the direction of, or moved closer to, the activated Sending Unit 30. Alternate embodiments are envisioned where the level of the signal remains the same, but the frequency of a beeping pattern increases (or decreases) as the tracking device is pointed in the direction of or moves closer to the target. Still further embodiments are envisioned where both the frequency and intensity of an audible signal could vary as the tracking device is pointed at or moved closer to the target.

The tracking device 80 may optionally include a screen that can provide visual information, such as one or more pointers or colors, specifying the relative direction of the activated Sending Unit and/or estimated distance information.

The above is but one of many examples of the alternative approaches enabled by the disclosed system. Others will be apparent to those ordinarily skilled in the arts when presented with this disclosure.

The figures described above, and the written description of specific structures and functions below are not presented to limit the scope of what has been invented or the scope of the appended claims. Rather, the figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

Aspects of the inventions disclosed herein may be embodied as an apparatus, system, method, or computer program product. Accordingly, specific embodiments may take the form of an entirely hardware embodiment, an entirely software embodiment or an embodiment combining software and hardware aspects, such as a "circuit," "module" or "system." Furthermore, embodiments of the present inventions may take the form of a computer program product embodied in one or more computer readable storage media having computer readable program code.

Reference throughout this disclosure to "one embodiment," "an embodiment," or similar language means that a feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all the items are mutually exclusive and/or mutually inclusive, unless expressly specified otherwise. The terms "a," "an," and "the" also refer to "one or more" unless expressly specified otherwise.

Furthermore, the described features, structures, or characteristics of one embodiment may be combined in any suitable manner in one or more other embodiments. Those of skill in the art having the benefit of this disclosure will understand that the inventions may be practiced without one or more of the specific details, or with other methods, components, materials, and so forth. In other instances, well-known structures, materials, or operations are not shown or described in detail to avoid obscuring aspects of the disclosure.

The description of elements in each figure may refer to elements of proceeding figures. Like numbers refer to like elements in all figures, including alternate embodiments of like elements. In some possible embodiments, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed is:

1. A tracking system for use with an arrow comprising:

a sending unit, the sending unit comprising:

an electronic circuit that includes a battery and that, when activated, is configured to emit a tracking signal, wherein the electronic circuit includes a switch element such that the electronic circuit is maintained in a deactivated state when proximate a magnetic field and in an activated state when not proximate to a magnetic field;

a main body section affixed to the electronic circuit; and a projection integrally formed with the main body section, the projection extending from the main body section and tapering to a point; and a base unit, the base unit defining an open space configured to receive at least a portion of the sending unit, the base unit comprising:

a proximate end configured to be coupled to an end of an arrow shaft; and a second end configured to be coupled to an arrow tip and wherein the projection extending from the main body section of the sending unit projects towards the second end of the base unit when the sending unit is received in the open space of the base unit; and a magnet providing a magnetic field, the magnet being positioned such that the electronic circuit within the sending unit is maintained in a deactivated state when the sending unit is received in the open space of the base unit.

2. The tracking system of claim 1 wherein the base unit further comprises a lever assembly including a movable lever that extends from at least a portion of the base unit opposite the open space, wherein the lever assembly is configured to engage the sending unit in such a manner that movement of the lever will tend to pry the sending unit out of the open space within the base unit.

3. The tracking system of claim 1 wherein the sending unit further comprises first and second projections extending from the main body section such that they at least partially surround the magnet when the sending unit is received in the open space of the base unit.

4. The tracking system of claim 1 wherein the electronic circuit comprises an antenna and wherein the main body section of the sending unit defines an opening through which at least a portion of the antenna passes.

5. The tracking system of claim 1 wherein the base unit is formed from a non-magnetic material.

6. The tracking system of claim 1 wherein the base unit has a weight and the base unit's weight is within 5 grains of 50 grains.

7. The tracking system of claim 6 wherein the sending unit has a weight and the sending unit's weight is within 5 grains of 30 grains.

8. The tracking system of claim 7 wherein the magnet has a weight and the magnet's weight is within 2 grains of 10 grains.

9. The tracking system of claim 1 in combination with an arrowhead and an arrow shaft.

10. The tracking system of claim 9 wherein the arrowhead includes a section defining female, wherein the proximate end of the base unit defines male threads, and wherein the male threads are received by the female threads.

11. The tracking system of claim 1 wherein, when the sending unit is received in the open space of the base unit, the magnet is movable within the open space, and magnetic attraction between the battery and the magnet tends to hold the sending unit within the open space.

12. A trackable arrow assembly comprising:

a shaft assembly defining proximal and distal ends and an open area between the proximal and distal ends, wherein the proximal end of the shaft assembly is configured to be coupled to an arrow head and wherein the distal end of the shaft assembly is configured to be coupled to an arrow shaft, and wherein the proximal end of the shaft assembly defines a ramped surface;

a magnet disposed within the open area between the proximal and distal ends of the shaft, the magnet exhibiting a magnetic field; and a sending unit including a main body, an electronic circuit, and a point capable of penetrating at least a portion of a target, where at least a portion of the sending unit is configured to extend into the shaft assembly open area;

wherein the electronic circuit is maintained in a deactivated state when located within the magnetic field and is activated to emit a tracking signal when located outside the magnetic field; and wherein the sending unit is configured to be removably coupled to the base unit in a manner that a striking of a target by an arrow to which the trackable arrow assembly is coupled will result in the sending unit separating from the shaft assembly as the shaft assembly moves into the target and movement of the electronic circuit outside of the presence of the magnetic field.

13. The trackable arrow assembly of claim 12 wherein the shaft assembly is cast from a nonmagnetic material.

14. The trackable arrow assembly of claim 12 wherein the shaft assembly is formed from a high-strength plastic material.

15. The trackable arrow assembly of claim 12 wherein the magnet forms a rod having a length and a generally circular outer diameter that is substantially constant along the length of the rod.

16. The trackable arrow assembly of claim 12 wherein the electronic circuit includes an antenna.

17. The trackable arrow assembly of claim 16 wherein the antenna does not protrude from the sending body.

18. The trackable arrow assembly of claim 12 wherein the shaft assembly comprises a lever assembly configured to engage the sending unit such that movement of the lever will tend to pry the sending unit out of the open area defined by the shaft assembly.

19. An apparatus for tracking an arrow comprising:

a base element having first and second ends, wherein the first end is adapted to be coupled to an arrowhead and the second end is adapted to be coupled to an arrow shaft;

the base element defining a generally tubular interior space;

a magnet having a rod shape adapted to be positioned within the generally tubular interior space;

a sending unit including a main body terminating in a pointed tip and an electronic circuit configured to be in a deactivated state when located physically near the magnet and further configured to activate and emit a tracking signal when separated from the magnet;

wherein the sending unit defines a body feature configured to extend into the generally tubular interior space of the base element;

wherein the rod-shaped magnet is configured to move within and along the generally tubular space interior space from a first position to a second position and wherein magnetic attraction between the rod-shaped magnet and at least a portion of the electronic circuit tends to retain the sending unit at least partially within the generally tubular interior space when the rod-shaped magnet is in the first position and wherein the magnet is retained within the base element in the second position when the sending unit is separated from the magnet.

20. The apparatus for tracking an arrow of claim 19, wherein the electronic circuit includes a battery and wherein the battery is magnetically attracted to the rod-shaped magnet when the rod-shaped magnet is in the first position.

* * * * *